United States Patent [19]

Lautenschalger, Jr. et al.

[11] Patent Number: 4,972,546

[45] Date of Patent: Nov. 27, 1990

[54] OVER-CENTER HINGE

[75] Inventors: Karl Lautenschalger, Jr., Reinheim; Gerhard Lautenschläger, Brensbach 1-Wersau, both of Fed. Rep. of Germany

[73] Assignee: Karl Lautenschlager, GmbH & Co. KG, Reinheim, Fed. Rep. of Germany

[21] Appl. No.: 160,522

[22] Filed: Feb. 26, 1988

[30] Foreign Application Priority Data

Mar. 18, 1987 [DE] Fed. Rep. of Germany ..... 3708703

[51] Int. Cl.[5] ..... E05D 5/00

[52] U.S. Cl. ..... 16/288; 16/291; 16/294; 16/296; 16/370; 16/72; 16/385

[58] Field of Search ..... 16/273, 288, 291, 294, 16/296, 370, 385; 292/DIG. 57; 428/908.8

[56] References Cited

U.S. PATENT DOCUMENTS

| | | | |
|---|---|---|---|
| 3,837,042 | 9/1974 | White | 16/385 |
| 4,184,228 | 1/1980 | Lautenschlager et al. | 16/294 |
| 4,251,900 | 2/1981 | Lautenschlager | 16/296 |
| 4,536,917 | 8/1985 | Rock et al. | 16/294 |
| 4,654,930 | 4/1987 | Lautenschlager, Jr. et al. | 16/296 |

FOREIGN PATENT DOCUMENTS

| | | | |
|---|---|---|---|
| 2516084 | 10/1976 | Fed. Rep. of Germany . | |
| 2753904 | 6/1979 | Fed. Rep. of Germany | 16/385 |
| 3137552 | 4/1983 | Fed. Rep. of Germany | 16/294 |

OTHER PUBLICATIONS

G. Diefer, *Mechanical Metallurgy,* McGraw-Hill, p. 569, 1976.
(Chpt. 15-*Fundamentals of Metalworking*).

*Primary Examiner*—Richard K. Seidel
*Assistant Examiner*—Edward A. Brown

[57] ABSTRACT

An over-center hinge for cabinet doors with a door-related hinge part in the form of a recess-mounting cup in which one end of each of two links is journaled whose other ends are journaled on a jamb-related hinge part in the form of an elongated supporting arm. On the side of the inner link facing the outer link a cam is articulated with its free end facing the supportring arm and is urged by a spring inserted between the cam and the pivot eye of the inner link against a counter-surface formed by a section of the inner wall of the supporting arm such that its face forces the hinge resiliently into the closed position upon passing a dead point in the closing movement. The section of the wall of the supporting arm that forms the counter-surface is provided at least in the surface area cooperating with the cam with a smooth, wear-resistant and friction-reducing surface.

9 Claims, 2 Drawing Sheets

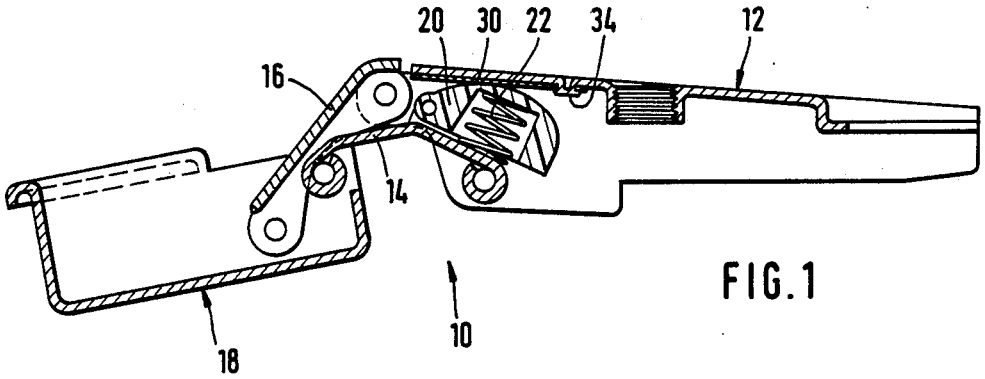
FIG.1
FIG.2
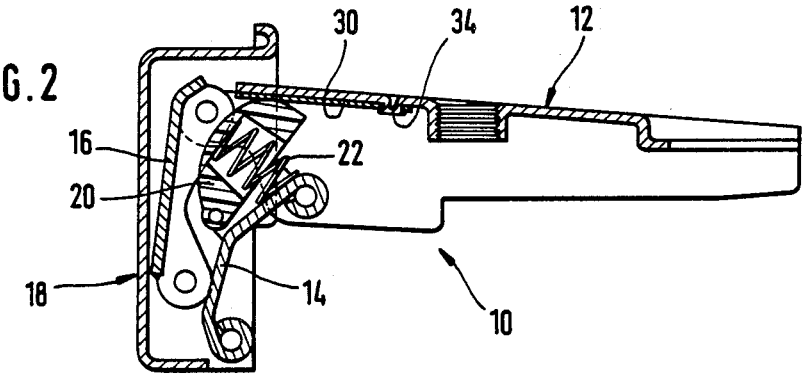
FIG.3
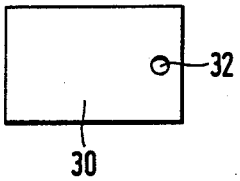
FIG.6
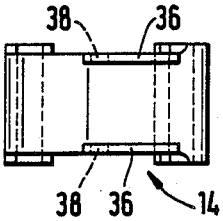
FIG.7
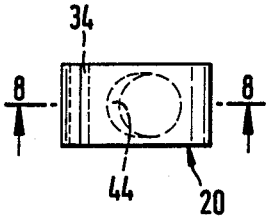
FIG.4
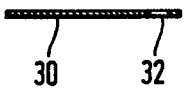
FIG.5
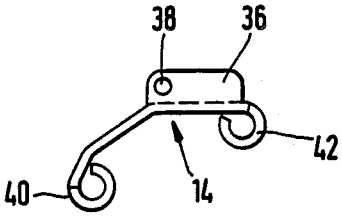
FIG.8
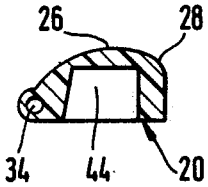

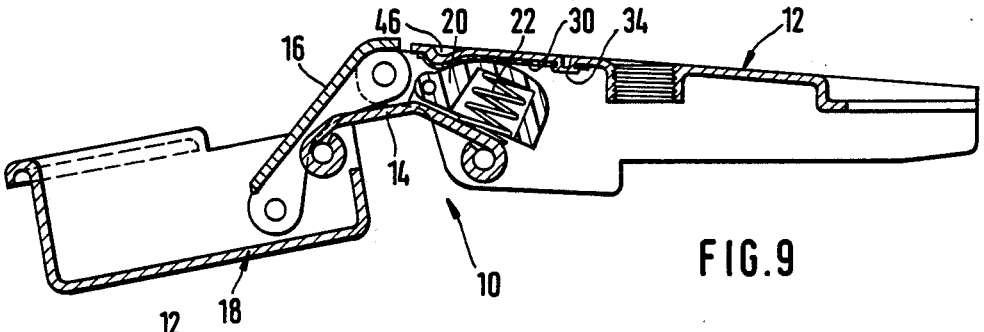
FIG.9
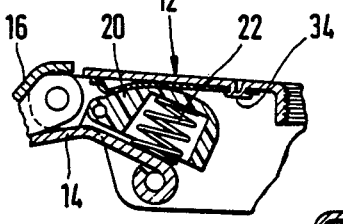
FIG.17
FIG.10
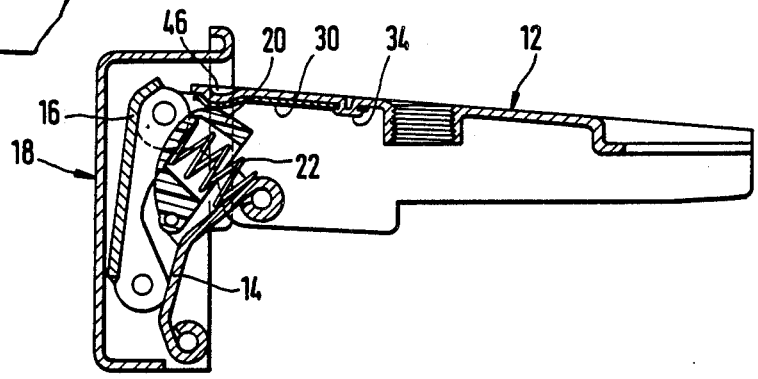
FIG.11
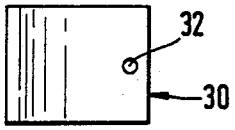
FIG.14
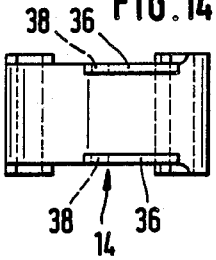
FIG.15
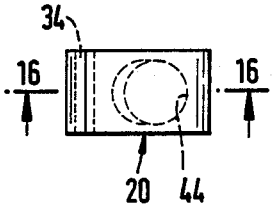
FIG.12
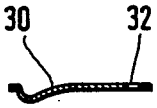
FIG.13
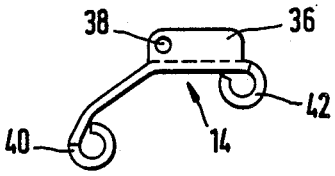
FIG.16
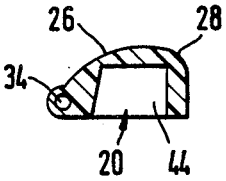

OVER-CENTER HINGE

BACKGROUND OF THE INVENTION

The invention relates to an over-center hinge for cabinet doors, having a door-related hinge part in the form of a sunken cup in which one end of each of two links is pivoted while the other ends are pivoted on a jamb-related hinge part in the form of an elongated supporting arm so as to form a rectangular articulation. On the side of the inner link facing the outer link, and between its pivot eyes, a cam is pivotally mounted with its free end pointing toward the supporting arm. The contact surface of this cam is urged by a spring inserted between the cam and the pivot eye provided on the supporting arm end of the inner link against a counter-surface formed by a section of the inner wall of the supporting arm such that in its closing movement, after a dead center is passed, the hinge is resiliently forced to the closed position.

Over-center hinges of this kind are known (DE-PS No. 25 16 084) and have proven practical on account of the compact and thus space-saving construction and the reliable operation of its over-center mechanism. The spring-biased cam is, in these known hinges, made from a plastic that has been optimized in regard to its frictional and wear-resistant properties and which has excellent stability as long as the metal counter-surface formed on the supporting arm is not very rough, i.e., if it is sufficiently smooth. In the case of the supporting arm stamped from sheet metal which is widely used, this requirement of sufficient smoothness of the counter-surface is satisfied easily, as a rule, if it is used in the bright form which it has when removed from the press die. To achieve a certain appearance, however, sheet metal supporting arms are often handled afterward such that their surface no longer has the good surface quality that is desired for cooperation with the face of the cam. An example is the sandblasting of the supporting arms, or the forming of galvanically dulled surfaces to achieve a uniformly matte appearance. These procedures roughen the supporting arm surface, including the area of the counter-surface, and a rough surface texture of this kind is less suited for cooperation with the contact surface of the plastic cam, because it acts like a very fine file, i.e., it removes material from the contact surface and thus gradually changes the movement and hence also the operating characteristic of the hinge. Even in the case of lacquered supporting arms the lacquer is applied to intentionally roughened surfaces to promote good adhesion. In the area applied to the counter-surface the lacquer, however, wears through in a relatively short time, so that then a rough metal surface is again cooperating with the contact surface of the plastic cam. To avoid the above-described disadvantages it would indeed be possible to smooth the supporting arm in the area of the counter-surface by polishing, but this additional step in the manufacture of the hinge would unacceptably increase the cost, since an automatic sorting and polishing apparatus would have to be developed for the partial finish polishing of the counter-surface, which would call for an unreasonable investment. Furthermore, the problem would also exist that the metal particles removed by polishing would adhere to the adjoining areas of the rough metal surface, so that another cleaning operation would be necessary.

The invention therefore sets for itself the task of improving the known hinge such that its over-center mechanism will operate reliably in the desired manner throughout its useful life when the supporting arm has been manufactured with an undesirably rough surface at the wall area that cooperates with the cam.

SUMMARY OF THE INVENTION

Setting out from a hinge of the kind described above, this task is accomplished according to the invention by providing at least that portion of the section of the wall of the supporting arm forming the counter-surface which cooperates with the cam with a smooth, wear-resistant and friction-reducing surface.

Preferably, the smooth, wear-resistant and friction-reducing surface is formed by one face of a thin plate of spring-hardened sheet metal. In this manner the desired, long-lasting surface match between the contact surface and the counter-surface actually formed on the supporting arm is obtained even though the supporting arm itself is unacceptably rough.

The sheet metal plate is best affixed to the supporting arm by prolonging it beyond the area serving as the counter-surface for the cam and riveting it to the wall of the supporting arm at its prolonged portion. Automatic machinery with which such riveting can be performed automatically is available in factories making metal hardware, so that the necessary investment required by such automatic machinery is limited.

At the same time the configuration is best made such that the metal plate has at least one through-hole in the prolonged portion, into which material from the opposite wall of the supporting arm is driven and is upset against the surface. Since the material of the supporting arm wall itself is used for this riveting, the necessity of feeding separate rivets into place is eliminated.

In order to obtain an over-center characteristic biasing the hinge or a door mounted with the hinge exclusively to the closed position, the contact surface of the cam has a section of its surface that is bent in an approximately arcuate manner which is the first to slide on a counter-surface in the movement of the hinge, and this surface section is adjoined by a section that is bent more strongly in the same direction than is the surface section in the area of the dead center. In an advantageous further improvement of the invention, the counter-surface in the supporting arm can then be a flat section of the surface of the web of the supporting arm, the position and shape of the contact surface being then adaptable to achieve the desired over-center characteristic of this flat counter-surface.

Alternatively, the counter-surface can also be provided on a partially flat section of the surface of the web of the supporting arm, and, in the area over which the contact surface of the cam passes as the closed position of the hinge is approached, it can have an end section projecting toward the cam having a flank that is curved to correspond to an arcuately curved surface section of the cam. This modified embodiment has the advantage that the contact surface engages the supporting arm counter-surface not only with a line contact but also on a broad area through part of the hinge movement, resulting in less wear. Furthermore, the dimension of the cam in the linear direction of the supporting arm can be kept slightly smaller.

The projecting end section of the counter-surface can be formed by a corresponding indentation in the surface of the web of the supporting arm, which is then apparent also in the side of the supporting arm that is externally visible.

If such a visible indentation is not desired, the projecting end section of the counter-surface can also be formed by a sheet metal plate held in contact with the correspondingly curved section of the otherwise flat sheet metal plate held in contact with the altogether flat web of the supporting arm.

Instead of forming the smooth surface on a plate separately mounted in the supporting arm, the area of the supporting arm wall cooperating with the cam can be hardened and pressed smooth without machining, by a smooth-surfaced die applied with pressure during the assembly of the hinge.

BRIEF DESCRIPTION OF THE DRAWING

The invention is further explained in the following description of several embodiments in conjunction with the drawing, wherein:

FIG. 1 is a longitudinal central section through a first embodiment of the over-center hinge according to the invention in the open state of the hinge, FIG. 2 is a longitudinal central section through the hinge shown in FIG. 1 in the closed state of the hinge, FIGS. 3 and 4 are a top view and longitudinal central section, respectively, of a sheet metal plate used in the hinge of FIGS. 1 and 2, FIGS. 5 and 6 are a side view and a top view, respectively, of the inner hinge link, FIGS. 7 and 8 show the cam of the hinge according to FIGS. 1 and 2 in a top view and a cross section along line 8—8 of FIG. 7, respectively, FIGS. 9 and 10 are longitudinal central sections through a modified embodiment of the hinge according to the invention in the open and closed position, respectively, FIGS. 11 and 12 are a top view and a longitudinal central section, respectively, of the sheet metal plate forming the counter-surface in the hinge according to FIGS. 9 and 10, FIGS. 13 and 14 are a side view and top view, respectively, of the inner hinge link, FIGS. 15 and 16 are a top view of the cam of the hinge according to FIGS. 9 and 10, and a cross-section along the line 16—16 in FIG. 15, and FIGS. 17 is a longitudinal section showing a detail of a hinge according to the invention having a modified over-center mechanism.

DETAILED DESCRIPTION OF PREFERRED EMBODIMENTS

An over-center hinge identified as a whole by the number 10 is shown in FIGS. 1 and 2. The hinge 10 has, in the usual manner, a supporting arm 12 which can be adjustably fastened on a mounting plate (not shown) previously mounted on the jamb of a cabinet. At the outer end of the supporting arm 12, which is on the left in the figures, a shorter inner link and a slightly longer outer link 14 and 16, respectively, are pivotally mounted, whose other ends are pivotally mounted in a cup 18 forming the door-related hinge part, which can be driven in place. The supporting arm is thus connected to the cup by a so-called four-joint linkage.

The over-center mechanism consists of a cam 20 pivotally articulated on the upper side of the inner link 14 between the latter's ends (see also FIGS. 7 and 8) and a compression spring in the form of a coil spring 22 which is mounted with bias between the end of link 14 articulated on the supporting arm 12 and the cam, and urges the outer surface of the cam against the inside surface of the upper web of the supporting arm 12.

The cam 20 made preferably of plastic has, as best seen in FIGS. 7 and 8, an approximately arcuately curved surface section 26 which, when the hinge is closing, slides from the open position shown in FIG. 1 to the closed position shown in FIG. 2, initially on the inside surface of the web of the supporting arm 12. Shortly ahead of the closed position, a more sharply curved surface section 28 follows which as soon as it acts on the inside surface of the supporting arm, produces a thrust forcing the inner link 14 in the closing direction due to the then changing course of the force acting between the cam 20 and the surface of the web of the supporting arm 12. The link 14 and thus the cup 18 are therefore forced in the closing direction in that instant and held in the closed position in which the surface section 28 is thrust against the inside surface of the web of the supporting arm 12. Upon the transfer of the supporting arm from the closed position to the open position, i.e., when a cabinet door provided with the hinge 10 is opened, for example, the inside surface of the web of supporting arm 12, which is cooperating with the cam 20, first slides under thrust on the surface section that seeks to hold the cabinet door in the closed position and then can be pushed against only slight resistance over the surface section 26 into the open position. The reason for this, that no marked closing or opening thrust occurs at this point, is that the curvature of the arcuate surface section 26 is so selected and the cam is so aligned with the pivot eye on the supporting arm that the force prevailing between the surface section 26 and the associated supporting arm surface is aligned through the pivot eye of the inner link 14 and thus no thrust can build up in this link.

The inner surface of the web of the supporting arm 12, which cooperates with the cam, is covered with a thin plate 30 of spring steel which is riveted to the inner surface of the web of the supporting arm 12. For this purpose a hole 32 is punched through an area of the plate 30 in an area outside of the area cooperating with the cam, and into it material from the flat web of the supporting arm 12 is driven and is then upset onto the surface of plate 30 facing away from the web, as is indicated in FIGS. 1 and 2 at 34. The sheet steel plate 30 is flat to match the flat shape of the web of the supporting arm.

The cam 20 made, as mentioned above, of plastic has a bore 34 (FIG. 8) for its pivotal connection to the link 14. Lateral tabs 36 having bores 38 are formed integrally on the inner link 14, which is stamped from sheet metal, and they are bent upwardly at right angles in the finished link 14. A pin passed through the bores 38 in the tabs 36 and the bore 34 in the cam 20 then forms the pivot axis of the cam. The pivot eyes 40 and 42 of the link 14 are, in the embodiment represented, formed by rolling the ends of the stamped-out link blank in a known manner, but they can also, like the corresponding pivot eyes of the outer link 16, be formed by bores in tabs bent laterally from the link itself.

The ends of the compression springs 22 are supported at one end in the blind bore 44 of cam 20 shown in FIG. 8, and at the other end on the terminal portion of the inner link 14 that lies between the tabs 36.

A slightly modified embodiment of an over-center hinge 10 is shown in FIGS. 9 and 10, which differs from the hinge 10 shown in FIGS. 1 and 2 and described above in the configuration of the counter-surface of the supporting arm 12 that cooperates with the cam, and, for adaptation to the modified counter-surface, in a slightly different shape of the cam 20. To avoid unnecessary repetition, therefore, only these differences will be described below, it being otherwise sufficient to refer to the foregoing description, inasmuch as equal parts of the two embodiments are associated in the drawing with the same reference numbers.

The otherwise flat surface of the web of the supporting arm 12 of the hinge 10 shown in FIGS. 9 and 10 is provided, in the area cooperating with the cam 20, with an indentation 46 between the supporting arm sides which produces on the opposite face of the web an arcuately curved protuberance 48 whose radius corresponds to the surface section 26 of the cam 20. When the hinge is turned from the open position (FIG. 9) to the closed position (FIG. 10), therefore, first the complementary surface sections 26 of the cam 20 and 48 of the indentation 46 slide against one another until, just before reaching the closed position, the more sharply curved surface section 28 of cam 20 passes over the highest point of the indentation 46 and then delivers the closing thrust in a different direction. The plate 30 that constitutes the actual counter-surface for cam 20 and is provided on the inside surface of the web of the supporting arm 12, is shaped from spring steel to match the indentation 46, i.e., it has a cross-sectional shape to match the cross-sectional shape of the indentation 46 (see also FIGS. 11 and 12).

The change in the counter-surface in the supporting arm also calls for a corresponding change in the shape of the cam, but it is only slight, as can be seen in FIGS. 15 and 16, and is limited practically to a slightly sharper curvature of surface section 28, so that the cam also becomes slightly shorter. The inner link 14 (FIGS. 13 and 14), however, remains unaltered.

Lastly, another modification of the hinge according to FIGS. 9 and 10 is described in FIG. 17, wherein the indentation 46 in the web of the supporting arm is not provided, while on the other hand the sheet metal plate 30 shown in FIGS. 11 and 12 and shaped like the indentation 46 is used. The material must only be slightly thicker to prevent deformation. The hinge constructed in this manner thus has the appearance of the hinge according to FIGS. 1 and 2, while its over-center characteristic is the same as in the hinge of FIGS. 9 and 10.

In the case of a modified embodiment not represented in the drawing, the wear-resistant and friction-reducing smooth surface area of the wall of the supporting arm, which cooperates with the cam, can be produced without the installation of a separate plate of sheet metal, i.e., on the wall of the supporting arm itself, by causing a smooth pressing surface formed on a punch to act on the surface area with such a pressure that a smoothing combined with a simultaneous work-hardening of the surface is achieved in a station during the assembly of the hinge.

We claim:

1. An over-center hinge for cabinet doors, comprising a door-related hinge part in the form of a sunken cup, a jamb-related hinge part in the form of an elongated supporting arm, an inner link and an outer link, each having a first end pivotally mounted to the door-related hinge part, and a second end pivotally mounted to said jamb-related hinge part so as to form a rectangular linkage, a cam of a plastic material and having a free end pointing toward the supporting arm and being articulated to the inner link between said two links, a spring urging a face of the cam against a surface formed by a section of the supporting arm, such that the hinge during closing after passing a dead center area, is resiliently forced into a closed position, the surface being a smooth and friction-reducing, wear-resistant surface formed by a flat side of a thin plate of spring-hard sheet metal, the sheet metal plate having an extension beyond the section forming said surface and being riveted to the supporting arm at the extension.

2. A hinge according to claim 1, comprising at least one through-opening in said extension, into which material from the supporting arm is driven and upset against the plate.

3. A hinge according to claim 1 or 2, wherein the face of the cam has a first face section which is approximately arcuately curved and which slides first on the surface, and a second face section curved more sharply than the first face section and which next contacts the surface in the area of the dead center, the surface being formed on a flat section of a web of the supporting arm in a forward end portion of the supporting arm.

4. A hinge according to claim 1 or 2, wherein the face of the cam has a first face section which is approximately arcuately curved and which slides first on the surface, and a second face section curved more sharply than the first face section and which next contacts the surface in the area of the dead center, the surface being formed on a flat section of a web of the supporting arm and on an end section projecting toward the cam with a flank curved arcuately to complement the arcuately curved first face section of the cam.

5. A hinge according to claim 4, wherein the projecting end section is formed by an indentation of the web of the supporting arm.

6. A hinge according to claim 4, wherein the projecting end section is formed by a correspondingly bent section of the sheet metal plate.

7. An over-center hinge for cabinet doors, comprising a door-related hinge part in the form of a sunken cup, a jamb-related hinge part in the form of an elongated supporting arm, an inner link and an outer link, each having a first end pivotally mounted to the door-related hinge part, and a second end pivotally mounted to said jamb-related hinge part so as to form a rectangular linkage, a cam of a plastic material and having a free end pointing toward the supporting arm and being articulated to the inner link between said two links, a spring urging a face of the cam against a surface formed by a section of the supporting arm, such that the hinge during closing after passing a dead center area, is resiliently forced into a closed position, the surface being a smooth and friction-reducing, wear-resistant surface formed by a flat side of a thin plate of spring-hard sheet metal connected to the supporting arm, the face of the cam having a first face section which is approximately arcuately curved and which slides first on the surface, and a second face section curved more sharply than the first face section and which next contacts the surface in the area of the dead center, the surface being formed on a flat section of a web of the supporting arm and on an end section projecting toward the cam with a flank curved arcuately to complement the arcuately curved first face section of the cam.

8. A hinge according to claim 7, wherein the projecting end section is formed by an indentation of the web of the supporting arm.

9. A hinge according to claim 7, wherein the projecting end section is formed by a correspondingly bent section of the sheet metal plate.

* * * * *